US006044561A

United States Patent [19]

Baraky et al.

[11] Patent Number: 6,044,561

[45] Date of Patent: Apr. 4, 2000

[54] COMBINATION POCKET KNIFE AND LOCKET

[75] Inventors: David J. Baraky, Bala Cynwyd; Thomas E. Wells, Sr., Southampton, both of Pa.

[73] Assignee: Franklin Mint Company, Franklin Center, Pa.

[21] Appl. No.: 09/154,232

[22] Filed: Sep. 16, 1998

[51] Int. Cl.[7] ..... B26B 1/02

[52] U.S. Cl. ..... 30/153; 30/151; 30/155

[58] Field of Search ..... 30/151, 152, 153, 30/155, 125, 157; D8/100; 7/158, 170; 206/349, 579

[56] References Cited

U.S. PATENT DOCUMENTS

| | | | |
|---|---|---|---|
| D. 2,317 | 5/1866 | Oppenheimer . | |
| D. 11,749 | 4/1880 | Frary . | |
| D. 11,750 | 4/1880 | Frary . | |
| D. 12,904 | 4/1882 | Millin . | |
| D. 14,929 | 4/1884 | Korn . | |
| D. 21,766 | 8/1892 | Korn . | |
| D. 21,867 | 9/1892 | Korn . | |
| D. 34,315 | 4/1901 | KcKain . | |
| D. 35,482 | 12/1901 | Maussner . | |
| D. 40,998 | 11/1910 | Vom Cleff . | |
| D. 46,414 | 9/1914 | Peres . | |
| 46,788 | 3/1865 | Foote . | |
| D. 47,492 | 6/1915 | Lemiesz . | |
| D. 48,065 | 11/1915 | Kalnianczyn . | |
| D. 49,334 | 7/1916 | Gostylla . | |
| D. 51,051 | 7/1917 | Wasyliw . | |
| D. 54,686 | 3/1920 | Satzewich . | |
| D. 55,123 | 5/1920 | Haddix . | |
| D. 58,458 | 7/1921 | Bierbach . | |
| D. 61,220 | 7/1922 | Ochse . | |
| 61,229 | 1/1867 | Milliken . | |
| D. 75,185 | 5/1928 | Peters . | |
| D. 101,073 | 9/1936 | Tamis . | |
| D. 115,060 | 5/1939 | Barthman . | |
| D. 118,622 | 1/1940 | Haydel . | |
| D. 124,687 | 1/1941 | Beffert . | |
| 126,368 | 5/1872 | Almy . | |
| D. 145,234 | 7/1946 | Smoleroff | D22/3 |
| D. 153,988 | 5/1949 | Smoleroff et al. | D22/3 |
| D. 166,064 | 3/1952 | Blecher | D22/3 |
| D. 172,723 | 7/1954 | Polk | D22/3 |
| D. 172,724 | 7/1954 | Polk | D22/3 |
| D. 172,726 | 7/1954 | Polk | D86/10 |
| D. 189,298 | 11/1960 | Dowdy et al. | D22/3 |
| 209,359 | 10/1878 | Rahner | 30/125 |
| D. 210,406 | 3/1968 | Weissmann | D45/15 |
| 239,115 | 3/1881 | Roeber | 30/151 |
| 631,546 | 8/1899 | Miller | 30/155 |
| 638,555 | 12/1899 | Burton | 30/155 |
| 861,789 | 7/1907 | Zimmer | 30/153 |
| 1,428,296 | 9/1922 | Neft | 30/153 |
| 1,463,573 | 7/1923 | Champlin | 30/155 |
| 2,129,491 | 9/1938 | Chilson | 63/19 |
| 2,255,999 | 9/1941 | Kuehner | 63/19 |
| 2,736,959 | 3/1956 | Simon et al. | 30/123 |

*Primary Examiner*—Hwei-Siu Payer
*Attorney, Agent, or Firm*—Seidel Gonda, Lavorgna & Monaco, PC

[57] ABSTRACT

A combination pocket knife handle and locket is provided. The pocket knife includes a handle defining a longitudinal axis and includes a pair of handle members, a locket and a hatch for the locket. The handle members define a channel extending along the longitudinal axis. The locket is formed within one of the handle members. The locket has an interior space in which graphic indicia may be provided therein. The hatch is a pivotably attached to the one side of the locket to rotate open and closed to conceal and provide access to the locket. A knife blade is pivotably provided within the channel. In the preferred embodiment, the size and shape of the handle members are thematically related to the graphic indicia provided in the locket.

17 Claims, 2 Drawing Sheets

COMBINATION POCKET KNIFE AND LOCKET

FIELD OF THE INVENTION

The present invention relates generally to the field of pocket knives. In particular, the present invention relates to a handle for a pocket knife having a locket formed therein.

BACKGROUND OF THE INVENTION

Pocket knives have been designed and manufactured as decorative pieces. Often, pocket knives contain a handle having graphic indicia thereon that relates to a particular theme. The graphic indicia serve as part of the pocket knives' overall attractiveness to consumers. Pocket knives of this sort have become collector items and commemorative pieces. In addition to containing graphic indicia, pocket knives have been manufactured in combination with other items and devices. Pocket knives have been manufactured to include devices such as clocks, key rings, thermometers, magnifying glasses, and the like. Devices of this sort also contribute toward the overall attractiveness of pocket knives to consumers.

BRIEF DESCRIPTION OF THE INVENTION

The present invention relates to a pocket knife having a handle with a locket formed therein. The pocket knife includes a handle having a pair of handle members that are disposed in separate planes to form a channel. Each handle member has an outer surface and a side edge defining the periphery of the handle. A blade is pivotably mounted within the handle and adapted so that it may rotate from a closed, storage position within the channel to an open position. A compartment is formed within one of the handle members by a frame. The frame is defined by a plurality of upstanding walls that are joined to each other to define an interior space. Graphic indicia are provided in the interior space having sides edges that are shaped and dimensioned to mate with the upstanding walls. A support member positioned within the interior space adjacent the upstanding walls secures the graphic indicia within the interior space.

A hatch is pivotably attached to one of the upstanding walls to enclose the graphic indicia within the interior space of the compartment. The hatch is adapted to rotate from a closed position to an open position. The hatch includes a cover secured to a frame. The cover has a first side and a second side that include graphic indicia thematically related to the graphic indicia in the interior space of the compartment. A locking mechanism releasably retains the hatch in the closed position.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
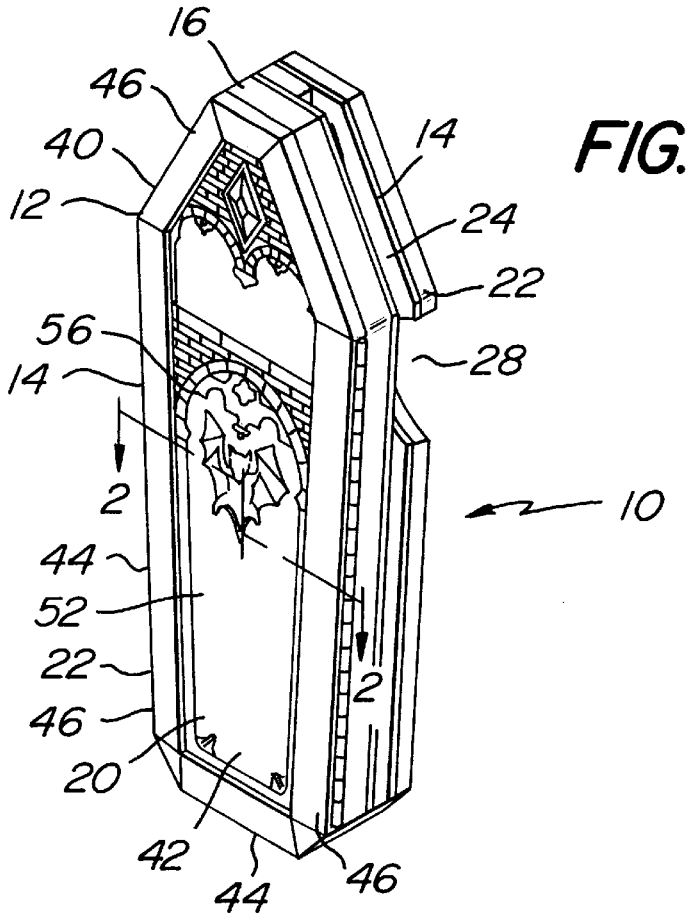
FIG. 1 is a perspective view of a pocket knife in accordance with the present invention.
Figure 2:
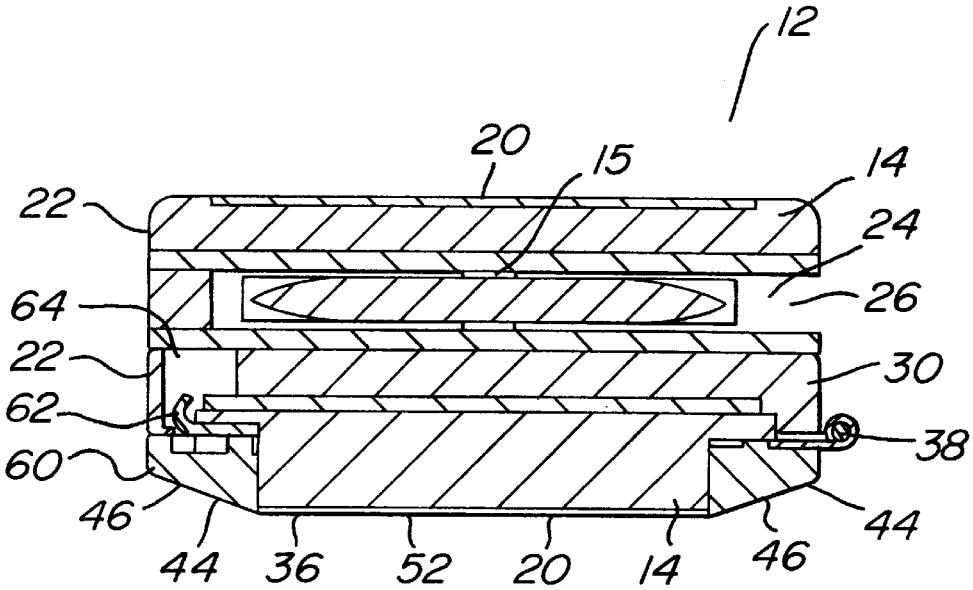
FIG. 2 is a sectional view of the pocket knife a s shown in FIG. 1, taken along line 2—2.

In the drawings wherein like numerals identify like elements, there is shown in FIG. 1 a pocket knife which is generally referred to by the numeral 10. The pocket knife 10 comprises a handle 12 having a pair of handle members 14 and a locket 16, and includes a blade 18 therewith. The handle members 14 have an outer surface 20 and a pair of oppositely disposed sides 22 that define the periphery of the handle 12. As shown in FIG. 2, the handle members 14 generally define a channel 24. The channel 24 is used to store the blade 18. The channel 24 may be positioned anywhere within the handle 12 so long as the blade 18 may be accessed for use. In the preferred embodiment shown, the channel 24 extends along a line parallel to the longitudinal axis of the handle 12 and includes an open top 26 positioned along one side 22 of the handle members 14. The open top 26 provides an opening through which the blade 18 may be removed.

As further illustrated in FIG. 2, the blade 18 is stored within the channel 24 intermediate the handle members 14. The blade 18 is pivotably attached to one end of the handle members 14 by a pivot pin 15 so that it may rotate to its open position from the storage position within the channel 24. The blade 18 is shaped and dimensioned to fit within the channel 24. In the preferred embodiment, the blade 18 has a pair of oppositely disposed edges that taper inwardly to form a point that is positioned at its forward end, opposite to the point of attachment at the rear. A beveled inset is positioned near the one of the edges to receive a thumbnail or fingernail so that the blade 18 may be rotated from within the channel 24. Preferably, one of the handle members 14 includes a recess 28 positioned to provide access to the beveled inset.

Other means for removably attaching the blade 18 to the handle 12 may be used in keeping with the scope of the present invention. For instance, the blade 18 may be removably attached to the handle members 14 so that it may slide from within the channel 24 when removed from its storage position. In addition, the blade 18 may be attached by a mechanism having a spring element that is activated by a push-button device. These and other types of mounting arrangements may be used in keeping with the scope of the present invention.

Figure 3:
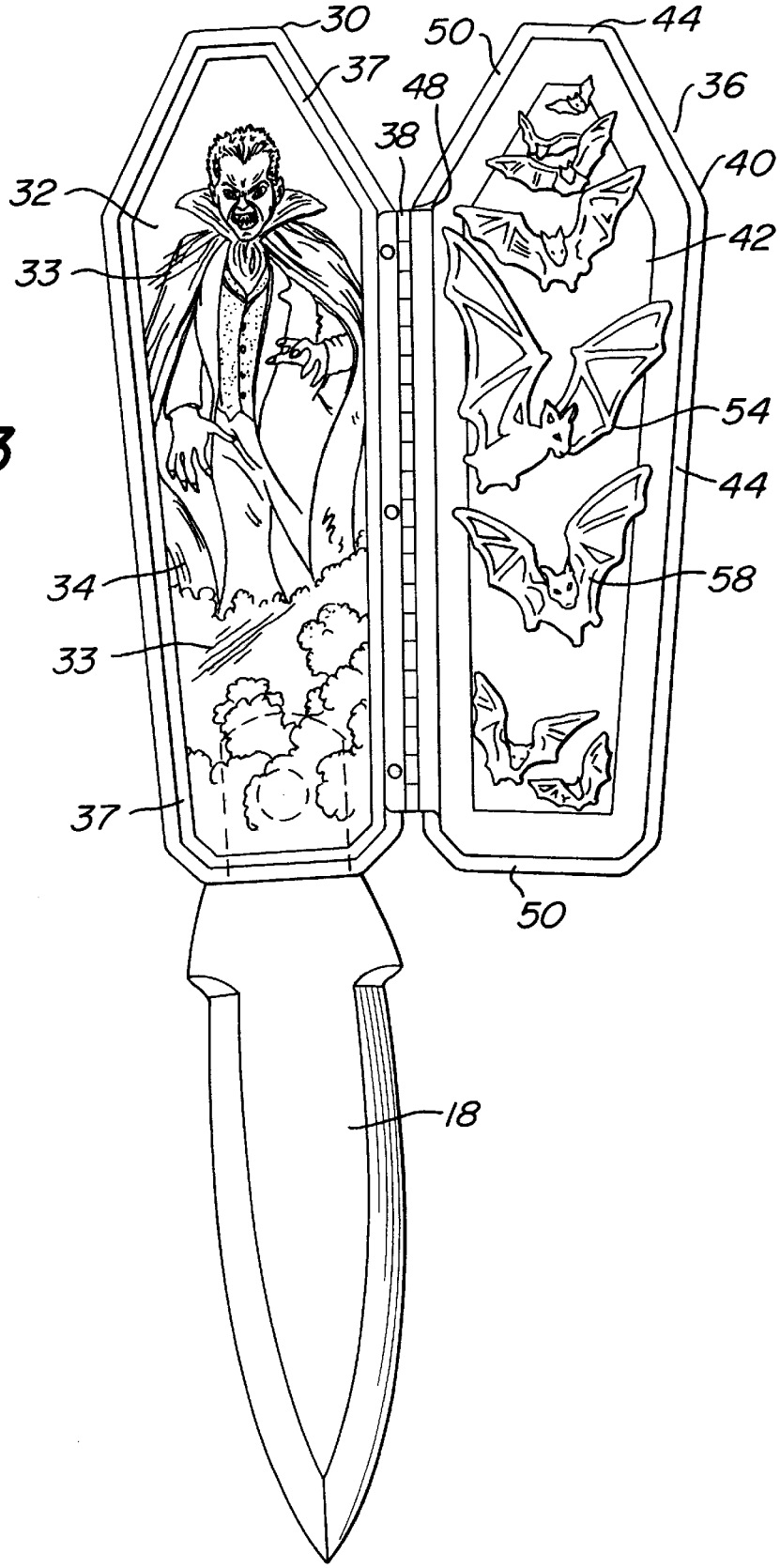
FIG. 3 is a top plan view of the pocket knife as shown i n FIG. 1 with the notch and blade rotated to their open position.

The locket 16 is formed within or may be secured to one of the handle members 14. As shown in FIGS. 1 and 3, the locket 16 includes a compartment 32 that is defined by a frame 30. The frame 30 includes a plurality of upstanding walls or side members 36 that define an interior space of the compartment 32.(See FIG. 3). Each of the upstanding walls 36 have a top surface and a side edge. In the preferred embodiment, the upstanding walls 36 are positioned around the periphery of the handle 12.

The compartment 32 may be formed anywhere within the handle member 14. The depth of the compartment 32 may vary depending upon the characteristics of the handle 12. Similarly, the interior space of the compartment 32 may be used to store any item so desired by the consumer.

As is more particularly shown in FIG. 3, graphic indicia 34 are provided within the interior space of the compartment 32. The graphic indicia 34 may include any type of display item, article, drawing, picture, photograph, illustration, lettering, memento, artwork or the like. The graphic indicia 34 may be laminated or include a sheet of transparent material 33 to protect it from damage. Alternatively, a sheet of transparent material having indicia thereon may be secured in the interior space. Preferably, the graphic indicia 34 is a photograph that includes side edges that are shaped and dimensioned to mate with the side edges of the upstanding walls 36. The graphic indicia 34 is positioned below the top surface of the upstanding walls 36 to form a recessed area.

In order to maintain the graphic indicia 34 within the interior space as secure as possible, a rim or inner support member 37 is provided. As shown in FIG. 3, the inner support member 37 is positioned adjacent to and formed inwardly along the upstanding walls. The inner support member 37 substantially conceals the side edges of the graphic indicia 34 from immediate view.

A hatch 36 or lid is provided to enclose the interior space of the compartment 32. As shown in FIGS. 1 and 3, the hatch 36 is pivotably attached along one of the sides of the locket 16 by a piano hinge 38 to control access to the graphic indicia 34. The hatch 36 is adapted to rotate from a closed position enclosing the graphic indicia 34 in the interior space of the compartment 32 to an open position. The open position of the hatch 36 is best seen in FIG. 3.

In the preferred embodiment, the hatch 36 includes a frame 40 and a cover 42. As illustrated in FIG. 1, the frame 40 is formed by a plurality of support or side members 44 that are joined to each other at the corners to define an enclosed space. Each of the support members 44 have an outer surface 46 and an inner surface 48. As shown in FIGS. 1 and 2, the outer surface 46 of the support members 44 are angled to give the hatch 36 a three-dimensional appearance. As best seen in FIG. 3, a rim 50 is formed around a portion of the periphery of the inner surface 48 of the support members 44. The rim 50 is used to position the cover 42, which is secured to the frame 40.

The cover 42 includes a first surface 52 and a second surface 54. The first surface 52 projects from the enclosed area formed by the frame 40 to form substantially an outer surface for the handle 12. Preferably, the first surface 52 includes graphic indicia 56 thematically related to the graphic indica 34 within the interior space of the compartment 32.

As best illustrated in FIG. 2, the second surface 54 of the cover 42 overlies the interior space of the locket 16 when the hatch 36 is in the closed position. The second surface 54 has side edges that are shaped and dimensioned to mate with the rim 50 and to fit within the recessed area formed within the frame 30 when the hatch 36 is closed. As shown in FIG. 3, the second surface 54 advantageously includes graphic indicia 58 thematically related to the graphic indicia 34 in the interior space of the compartment 32. When the hatch 36 is pivoted open, the graphic indicia 58 of the second surface 54 will appear alongside the graphic indicia 34 of the interior space of the compartment 32.

Returning to FIG. 2, a locking mechanism 60 releasably retains the hatch 36 in the closed position. The locking mechanism 60 is positioned adjacent one of the sides of the handle members 14. The locking mechanism 60 may include any type of device to control the opening and the closing of the hatch 36. As illustrated in FIG. 2, the locking mechanism 60 is a latch. The latch is formed by a flange 62 that projects outwardly from the hatch 36 and a recess 64 positioned to releasably receive the flange 62. Other means for maintaining the hatch 36 in a closed position may be used. For instance, the locking mechanism 60 may be positioned external of the locket 16 and advantageously include a push-button device having a spring element to cause the hatch 36 to rotate open.

It should be understood by those of ordinary skill in the art that the handle 12 for the pocket knife 10 may be formed having any size, shape and dimension. The handle 12 is preferably made of metal, but any material providing the structural integrity necessary to support the blade 18 and locket 16 is contemplated. The actual size and shape of the handle 12 may relate, in part, to the particular theme of the graphic indicia 34 provided in the interior space of the locket 16. Moreover, the handle 12 should be large enough to store whatever size blade 18 is used.

Alternatively, the handle 12 may be used to store a number of utensils, each having different shapes and sizes. The handle 12 may be combined with a locket 16, in a manner discussed above, and used for purposes other than for a pocket knife. For example, the handle 12 may be used to store a tool, a nail file, a key, or the like. In either embodiment, the handle 12 should be shaped and dimensioned to relate to a particular theme or the graphic indicia provide in the compartment of the locket.

For purposes of illustration and discussion, the pocket knife 10 depicted in FIGS. 1 to 3 is shaped in the form of a coffin. The shape of the handle 12 or handle members 14 is thematically related to the graphic indicia 34 in the interior space of the compartment 32 of which illustrates a vampire character. A sheet of transparent material 33 is provided within the interior space to overlie and to protect the photograph from damage. The sheet of transparent material 33 includes side edges that are also shaped and dimensioned to mate with the side edges of the plurality of upstanding walls 35 that define the frame 30 of the compartment 32. The side edges are hidden from immediate view by the inner support member 37. Both of the photograph and the sheet of transparent material 33 are provided underneath the inner support member 37. Alternatively, the graphic indicia 34 may include a sheet of transparent material having a vampire character image provided thereon. In either embodiment, the illustration of the vampire character and the shape of the handle 12 relate to the same general theme of vampires.

As shown in FIG. 1, the locket 16 and hatch 36 are shaped and dimensioned to conform and thematically relate to the shape of the handle member 14 and the vampire theme. As shown in FIG. 3, the hatch 36 is opened similar to a book by rotating it until it lies alongside the locket 16. The resulting orientation of the hatch 36 permits the graphic indicia 34 in the interior space of the locket 16 and the graphic indicia 58 of the second surface 54 of the cover 42 to be viewed simultaneously. As shown, the graphic indicia 58 of the second surface include images of bats that thematically relate to the illustration of the vampire character. Similarly, as best sheen in FIG. 1, the graphic indicia 56 on the first surface 52 of the cover 42 is also thematically related.

As further illustrated in FIG. 3, the blade 18 within the channel 24 is rotated about the pivot pin 15 until it reaches a locking position for use. As shown, the blade 18 projects outward from the handle members 14 along a line parallel to the handle 12.

Although the present invention has been described in detail in connection with the illustration shown in the drawings, it is to be understood that such detail is solely for that purpose and that variations may be made by those skilled in the art without departing from the spirit of the invention. Accordingly, the invention may be embodied in other specific forms without departing from the spirit or essential attributes thereof and, accordingly, reference should be made to the appended claims, rather than to the foregoing specification, as indicating the scope of the invention.

We claim:

1. In a pocket knife comprising:

a pair of handle members having substantially the same shape and dimension that are spaced away from each other to form a channel having an open top positioned along a side of the pocket knife, each handle member having an edge defining a periphery of the pocket knife and an outer surface, at least one of the handle members having graphic indicia thereon related to a particular theme, a compartment formed within one of the handle members, the compartment formed by a frame having a plurality of upstanding walls that are positioned around the periphery of the handle member to form an interior space, each of the upstanding walls having a top surface and a side edge, a picture provided within the interior space of the compartment, the picture having substantially hidden side edges that are shaped and dimensioned to mate with the side edges of the upstanding walls, a sheet of transparent material overlying the picture to protect it from damage, a rim provided in the compartment positioned adjacent the plurality of upstanding walls to secure the sheet of transparent material and the picture within the interior space, the rim substantially concealing the side edges of the picture and the sheet of transparent material from immediate view, a hatch pivotably attached to one of the upstanding walls of the frame by a piano hinge to enclose the picture and sheet of transparent material in the interior space, the hatch shaped and dimensioned to conform to the shape and dimension of the handle member of the compartment and having a frame formed around its periphery to support a cover having a first surface and a second surface, wherein both the first surface and the second surface include graphic indicia thematically related to the graphic indicia provided in the interior space, and a latch formed on a side of the handle member of the compartment to releasably retain the hatch in a closed position.

2. A pocket knife having a longitudinal axis comprising:

a pair of handle members disposed in separate planes parallel to one another to define a channel, each handle member having an outer surface and a side edge defining the periphery of the handle member, a compartment formed within one of the handle members by a plurality of upstanding walls that are joined to each other to define an interior space, each upstanding wall having a top surface and a side edge, graphic indicia provided in the interior space having side edges that are shaped and dimensioned to mate with the side edges of the upstanding walls, the graphic indicia positioned below the top surfaces of the upstanding walls to form a recessed area, an inner support member positioned adjacent to and inward of the upstanding walls to overlie a portion of and secure the graphic indicia in the interior space, the inner support member concealing the side edges of the graphic indicia, a hatch pivotably attached to one of the upstanding walls and adapted to rotate from a closed position enclosing the graphic indicia within the interior space of the compartment to an open position, the hatch having substantially the same shape and dimension as the compartment to engage the top surfaces of the upstanding walls to conceal the graphic indicia, a blade pivotably mounted within the channel and adapted to rotate from a closed, storage position within the channel to an open position external of the channel for use, and a locking mechanism for releasably retaining the hatch in the closed position.

3. The pocket knife as claimed in claim 1, further comprising a sheet of transparent material positioned underneath the inner support member to overlie the graphic indicia provided in the interior space of the compartment, the sheet of transparent material having side edges that are shaped and dimensioned to mate with side edges of the upstanding walls.

4. The pocket knife as claimed in claim 3, wherein the handle members are shaped and dimensioned to thematically relate to the graphic indicia in the interior space of the compartment.

5. The pocket knife as claimed in claim 4, wherein one of the outer surfaces of the handle members includes graphic indicia thematically related to the graphic indicia in the interior space of the compartment.

6. The pocket knife as claimed in claim 5, wherein the compartment is shaped and dimensioned to thematically relate to the graphic indicia in the interior space of the compartment.

7. The pocket knife as claimed in claim 6, wherein the hatch is shaped and dimensioned to thematically relate to the graphic indicia in the interior space of the compartment.

8. The pocket knife as claimed in claim 6, wherein the hatch further comprises a frame.

9. The pocket knife as claimed in claim 8, wherein the frame further comprises (i) a plurality of support members that are joined to each other to define an enclosed space, each of the support members having an outer surface and an inner surface, (ii) a rim formed around a portion of the periphery of the inner surface of the plurality of support members to mate with the top surfaces of the upstanding walls of the compartment, and (iii) a cover secured to the plurality of support members having a first surface and a second surface, the first surface shaped and dimensioned to fit within the enclosed space to form an outer surface for one of the handle members, the second surface having side edges that are shaped and dimensioned to mate with the rim and to fit within the recessed area when the hatch is closed.

10. The pocket knife as claimed in claim 9, wherein both the first surface and the second surface of the cover have graphic indicia thematically related to the graphic indicia in the interior space of the compartment.

11. The pocket knife as claimed in claim 10, wherein the outer surfaces of the plurality of support members of the hatch are angled to form a three-dimensional appearance.

12. The pocket knife as claimed in claim 11, wherein the graphic indicia in the interior space of the compartment is a photograph.

13. In a pocket knife having a handle assembly, the handle assembly having a pair of handle members spaced apart from one another to define a channel, the handle members having an outer surface and at least one side defining the periphery of the handle assembly, a knife blade pivotably mounted within the channel and adapted so that it may rotate from a closed, storage position to an open position, the handle assembly comprising:

a locket formed within one of the handle members by a frame having a series of side members joined to each other to form an interior space, each of the side members having a top surface and a side edge;

graphic indicia provided within the interior space related to a particular theme, the graphic indicia having side edges that are shaped and dimensioned to mate with the side edges of the side members of the frame, the graphic indicia positioned below the top surfaces to form a recessed area;

a rim positioned within the interior space of the locket adjacent the side members to secure the graphic indicia within the interior space;

a lid pivotably attached to one side of the frame and adapted to rotate from a closed position to enclose the graphic indicia within the interior space of the frame to an open position, the lid having a frame defined by a plurality of support members that are joined to each other to form an enclosed space, each support member having a first surface, a second surface, and a side edge; and a cover secured to the frame of the lid having a first surface and a second surface, the first surface projecting through the enclosed space to define an outer surface of the handle member having the locket, the second surface having side edges that are shaped and dimensioned to fit closely within the recessed area of the locket; and a locking mechanism attached to the cover for releasably retaining the lid in the closed position.

14. The handle assembly as claimed in claim 13, wherein the first surface and the second surface of the cover include graphic indicia thematically related to the graphic indicia in the interior space of the locket.

15. The handle assembly as claimed in claim 14, wherein the graphic indicia in the interior space of the locket includes a sheet of transparent material having an illustration thereon.

16. A handle for a utensil, the handle comprising:

a pair of spaced apart handle members to define a channel for removably receiving the utensil, each handle member having an outer surface and a side edge defining the periphery of the handle, a locket formed within one of the handle members, the locket having a frame that wraps around at least a portion of the periphery of the handle member having the locket to define an interior space, the interior space shaped and dimensioned to receive and laterally support side edges of graphic indicia related to a particular theme provided within the locket, a cover pivotably attached to the locket and adapted to rotate from a closed position overlying and concealing the graphic indicia in the interior space to an open position, the cover having a first surface, a second surface, and graphic indicia on the first surface and the second surface thematically related to the graphic indicia provided in the interior space of the locket, and a locking mechanism for releasably retaining the cover in a closed position.

17. The handle as claimed in claim 16, wherein the utensil is a knife blade.

* * * * *